United States Patent [19]

Machill

[11] Patent Number: 4,972,894

[45] Date of Patent: Nov. 27, 1990

[54] ROLLER CURTAIN

[76] Inventor: Rolf Machill, Karl-Schurz-Str. 6, 5000 Köln 41, Fed. Rep. of Germany

[21] Appl. No.: 453,012

[22] Filed: Dec. 20, 1989

Related U.S. Application Data

[63] Continuation of Ser. No. 254,521, Oct. 6, 1988, abandoned.

[51] Int. Cl.[5] ..... E06B 9/00

[52] U.S. Cl. ..... 160/235; 160/236; 160/41

[58] Field of Search ..... 160/235, 236, 232, 133, 160/40, 41, 42

[56] References Cited

U.S. PATENT DOCUMENTS

| | | | |
|---|---|---|---|
| 2,293,726 | 8/1942 | Fitch et al. | 160/236 X |
| 3,540,154 | 11/1970 | Claudio | 160/236 X |
| 4,368,772 | 1/1983 | Bouthillier | 160/232 |
| 4,409,758 | 10/1983 | Dickerson et al. | 160/231.2 X |
| 4,436,136 | 3/1984 | Downey, Jr. | 160/232 |
| 4,567,931 | 2/1986 | Wentzel | 160/236 X |
| 4,628,982 | 12/1986 | Labelle | 160/235 |
| 4,630,664 | 12/1986 | Magro | 160/232 |
| 4,644,725 | 2/1987 | Schijf | 160/232 X |

FOREIGN PATENT DOCUMENTS

| | | | |
|---|---|---|---|
| 635425 | 1/1962 | Canada | 160/40 |
| 2109838 | 9/1972 | Fed. Rep. of Germany . | |
| 2808177 | 8/1979 | Fed. Rep. of Germany . | |
| 2729235 | 11/1979 | Fed. Rep. of Germany . | |
| 2925635 | 1/1981 | Fed. Rep. of Germany . | |
| 3115729 | 11/1982 | Fed. Rep. of Germany | 160/236 |
| 3206997 | 9/1983 | Fed. Rep. of Germany | 160/236 |
| 2555243 | 5/1985 | France | 160/236 |
| 1444112 | 7/1976 | United Kingdom | 160/232 |
| 2165877 | 4/1986 | United Kingdom | 160/232 |

*Primary Examiner*—David M. Purol

[57] ABSTRACT

An insulated curtain slat for use in a roller curtain has inner and outer skins. The outer skin is typically made of a metal to protect against weather conditions, and the inner skin is generally made of a plastic material to minimize the transfer of heat between the inside and outside of the curtain. A space between the skins is foamed with an insulating material. The top and bottom of the outer skin are formed with hook-like ridges, so that neighboring slats may engage one another at a joint to form the roller curtain. A sealing edge is fastened to an edge of the inner skin of each slat. The sealing edge spans the joint between the neighboring slats and contacts the inner skin of the adjacent slat, thereby sealing the joint. The sealing edge is made of a rubber or elastic plastic material which, along with an air pocket created by the sealing edge, further reduces the transfer of heat between the inside and the outside of the roller curtain.

4 Claims, 4 Drawing Sheets

ROLLER CURTAIN

This application is a continuation, of application Ser. No. 07/254,521, filed Oct. 6, 1988 now abandoned.

BACKGROUND OF THE INVENTION

This invention relates to roller curtains. More particularly, it pertains to an improved method of insulating a roller curtain which includes several curtain slats, each slat consisting of an outer skin and an inner skin that are fit together at their edges and surround an insulating inner core.

The use of roller curtains in such items as roll-up doors is well known. Frequently, roller curtains are used in the entrance ways of warehouses and factories. When the curtain is in the rolled-down position, it blocks the entryway. Because the roller curtain is made of several slats connected together by joints, the roller curtain can be rolled up into a coil, usually on the top of the entryway.

Roller curtains are often used on exterior entryways. In this case, the outside portion of the curtain may be exposed to harsh weather conditions. For this reason, the slats are commonly made of two connected skins. The outside skin is generally made of metal to protect the curtain from the exterior weather conditions. Where the difference between the inside and outside temperatures are significant, however, the inner skin of the slats are not made of metal. Instead, the inner skin is made of a material that is resistant to heat transfer so that the heat on one side of the curtain is not transferred to the other side. Also, this permits a lighter material than metal to be used, which reduces the weight of the curtain. To further protect against heat transfer, it is common in the art to fill the space between the inner and outer skins with insulation. A problem area remains, however, where the slats are connected to one another.

In heat insulated roller curtains, as they are used for example with roll-up doors, the joint area between the various roller slats is a common source of heat dissipation. The joint connecting neighboring slats may have the metal outer skin of one slat hinged on the metal outer skin of a neighboring slat. In this case, the inside air is exposed to the metal skin which either directly contacts the outside air, or contacts another metal skin which contacts the outside air. Compounding the problem is the fact that the joints are not airtight. Thus, at certain pressure differences between the inside and outside air, an air flow is created which results in heat transfer. A lack of insulation in the joint area between the slats can result in a substantial amount of heat transfer, especially with large area roller curtains or where there is a high temperature difference between the sides of the curtain.

SUMMARY OF THE INVENTION

This invention provides a roller curtain formed of a plurality of interlocking curtain slats each of which comprises inner and outer skins with insulation between the skins. Neighboring slats are joined together along their edges at a joint. An elongated sealing strip is connected to an edge of the inner skin of at least one adjacent slat. When the adjacent slats are in a common plane, the sealing strip spans the space between the slats. Thus, this aspect of the invention minimizes the heat transferred from one side of the roller curtain to the other. The sealing strip creates an air pocket within the joint area that acts as an insulator. Also, the sealing strip retards heat transfer when constructed of a material having low heat transfer capabilities.

The edge of the skin defining a sealing surface for the sealing strip may follow a circular curvature whose center is at the pivot axis of the joint. In another aspect of the invention, the sealing surface is closest to the pivot axis at a position adjacent to the inner face of the slat, and the sealing surface curves away from the pivot axis as the sealing surface extends into the joint. Therefore, the sealing strip contacts the sealing surface only when the slats are in a common plane. This aspect of the invention significantly reduces the friction between the sealing strip and the sealing surface so that, even in a dust-burdened atmosphere, wear of the sealing edge is avoided.

In another aspect of the invention, the sealing strip includes a flared retaining section held by a retaining channel of the inner skin of the slat and also includes bulb sealing edge adapted to contact the adjacent slat. This aspect of the invention provides a sealing strip secured only at one end by a method other than adhesion or co-extrusion.

In another aspect, the sealing strip has a flared retaining section adjacent each edge. The retaining sections are each received in a retaining channel formed in each adjacent slat. This aspect of the invention provides a hermetic seal between the inside and outside of the curtain.

Thus, it is a principal object of the invention to provide a roller curtain which minimizes the heat transfer between the sides of the roller curtain.

It is another object of the invention to reduce the amount of wear of the sealing strip due to the raising and lowering of the curtain.

It is still another object of the invention to provide a sealing strip secured only at one end by a method other than adhesion or co-extrusion.

It is yet another object of the invention to provide a hermetic seal between the inside and the outside of the roller curtain.

The foregoing and other objects and advantages of the invention will appear in the following detailed description. In the description, reference is made to the accompanying drawings which form a part hereof, and in which there is shown by way of illustration, preferred embodiments of the invention. Such embodiments do not necessarily represent the full scope of the invention, however, and reference is made therefore to the claims herein for interpreting the scope of the invention.

DETAILED DESCRIPTION OF THE PREFERRED EMBODIMENTS

Figure 1:
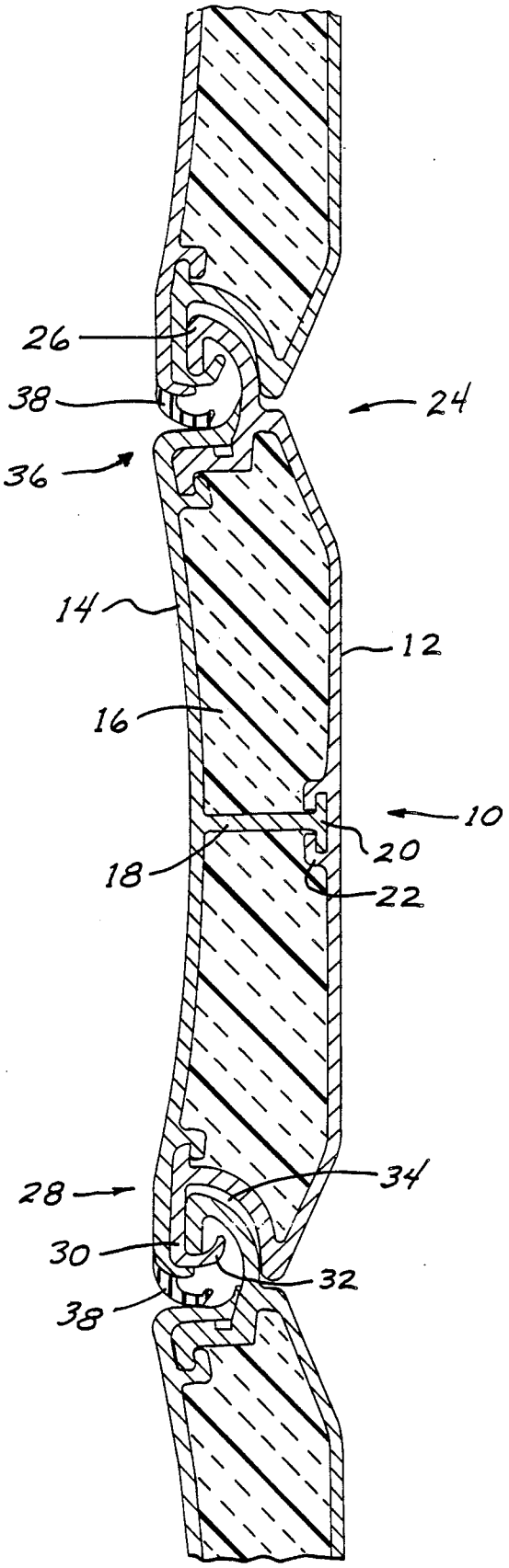
FIG. 1 is a view in vertical section of a roller curtain in its rolled down position.

A roller curtain (not shown) is constructed by connecting several roller slats 10 as shown in FIG. 1. Each roller slat 10 includes an outer skin 12, generally made of metal, and an inner skin 14, generally made of a plastic material such as a relatively rigid PVC. The inside of the curtain is generally the area located on the same side as the inner skin 14. Correspondingly, the outside of the curtain is typically the area located on the same side as the outer skin 12. The metal outer skin 12 is better able to stand up to exterior weather elements should the roller curtain be used on the entrance way to a building. The inner skin 14 and the outer skin 12 are connected to form an inner space which is foamed with a heat insulating material 16, such as polyurethane. A ridge 18, that is part of the inner skin 14, extends through the length of the slat 10. A flange 20, at the end of, and perpendicular to, the ridge 18, fits into a retaining channel 22 in the outer skin 12. The ridge 18 separates the inner space of the slat 10 into two halves and absorbs the foaming pressure during the foaming process and stabilizes the structure of the slat 10 against vertical stress during roll up of the roller curtain.

An upper edge 24 of the outer skin 12 has a hook-like ridge 26 directed toward the inner skin 14 of the slat 10. A lower edge 28 of the outer skin 12 has a hook-like ridge 30 directed toward the outer skin 12 of the slat 10. The hook-like ridge 30 has a free end 32 which points upward toward a hollowed out channel 34 of the lower edge 28 of the slat 10. The hook-like ridges 26 and 30 of each neighboring slat engage to form the joint which connects neighboring slats. The curtain is assembled by inserting the hook-like ridges 26 and 30 of each slat 10 into one another. The shape of the slats 10 and the use of joints to connect the slats 10 allow the slats 10 to move relative to one another and permit the roller curtain to roll up.

A joint space 36 between neighboring slats 10 is closed off through a sealing edge 38 (FIG. 1) which is fastened to the lower edge 28 of the inner skin 14 of each roller slat 10. The sealing edge 38 is preferably made of a rubber or an elastic plastic material. A preferred material for the sealing edge is a flexible PVC having a Shore hardness of between 65 and 70. The sealing edge 38 is connected to the inner skin 14 by coextrusion or by a method of adhesion such as solvent or sonic welding. Making the sealing edge 38 of either rubber or plastic helps stop the transfer of heat between the inside and outside of the curtain because both of these materials have a very low heat transferability as compared to metal which is used on the outer skin 12.

Figure 2:
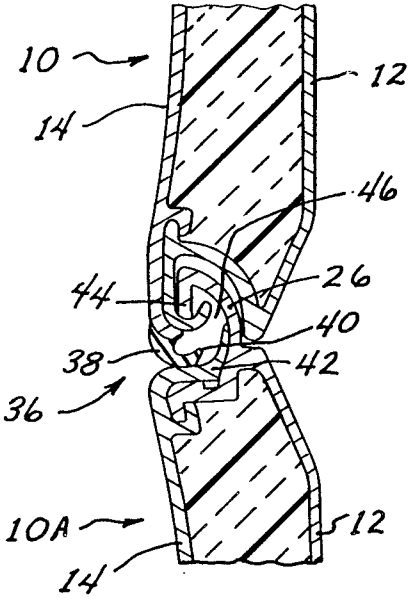
FIG. 2 is a view in vertical section of the joint area for the roller curtain according to FIG. 1.

As seen in FIG. 2, the sealing edge 38 has a lip-like appearance and is curved with a free edge 40 positioned inside the joint space 36. The free edge 40 points toward, rather than away from, the joint space 36, and points in the direction of the outer skin 12. In the neighboring lower roller slat 10A, an upper edge 42 of the inner skin 14 extends into and over the inner area of the hook-like ridge 26 of the outer skin 12. Viewed in section, the upper edge 42 of the inner skin 14 is formed as a curved, circular surface, whose center lies approximately at the axis of the joint, which is defined by a supporting lip 44 of the hook-like ridge 26 of the outer skin 12. With the curtain in the rolled down position, the sealing edge 38 contacts the upper edge 42 of the inner skin 14 of the neighboring slat 10A (FIG. 2). The free edge 40 of the sealing edge 38 is positioned between the upper edge 42 and the pivot axis of the joint. In this way, an air pocket 46 is formed in the joint space 36. The air pocket 46 further reduces heat transfer because the air in the air pocket 46 acts as an insulator. More importantly, however, is that the joint space 36 is sealed by the sealing edge 38 which is made of a material that has low heat transfer capabilities.

When the roller curtain is rolled up, the sealing edge 38 remains in contact with the inner skin 14 of the neighboring slat (10A in FIG. 2). During roll up, the outside of the slats 10 open up and the inside closes, thus the free edge 40 of the sealing edge 38 simply slides along the upper edge 42 of the inner skin 14 of the lower roller slat 10A. In this way, the joint space 36 is always closed by the sealing edge 38. Therefore, no foreign objects may enter the joint space 38 due to the constant presence of the sealing edge 38.

Also, no stress is experienced against the sealing edge 38 during roll up of the curtain, outside of the change of the position of the sealing edge 38 during movement of the slats 10. Wear of the sealing edge 38 during movement of the curtain is further minimized because the sealing edge 38 is designed to contact the upper edge 42, of the inner skin 14 of the lower slat 10A. The upper edge 42 of the inner skin 14 is slightly curved and preferably made of plastic. Contact between these surfaces in this manner virtually eliminates wear.

Another advantage of this design results from the sealing edge 38 being located on the inside of the roller curtain. The sealing edge 38 is not exposed to the exterior weather. In particular, the sealing edge 38 is not exposed to direct sunlight which is destructive of the types of materials used in making the sealing edge 38. Additionally, the free edge 40 of the sealing edge 38 is located inside the joint space 36. This protects the free edge 40 and the upper edge 42 of the neighboring slat 10A from any damage due to adverse influences from the outside. Furthermore, positioning of the sealing edge 38 on the inside of the roller curtain provides a smooth surface on the inside of the curtain.

Figure 3:
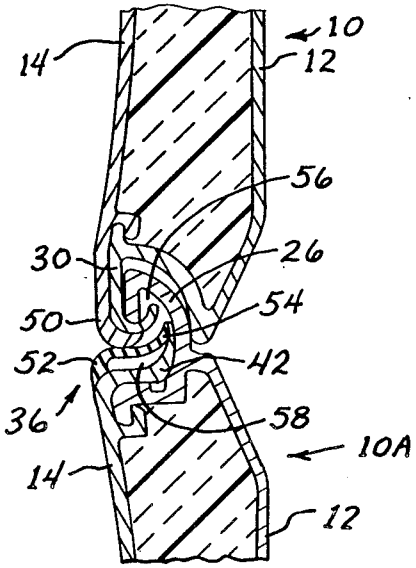
FIG. 3 is a view in vertical section similar to FIG. 2 but showing another embodiment of the invention.

The design in FIG. 3 shows another embodiment of the invention. A lower edge 50 of the inner skin 14 of the upper roller slat 10 is extended over the exterior of the hook-like ridge 30 of the outer skin 12 of the upper roller slat 10. The lower edge 50 is made of the same material as the rest of the inner skin 14. In this embodiment of the invention, a sealing flap 52 is attached, either through adhesion or co-extrusion, to the inner skin 14 of the slat 10A such that a free edge 54 of the sealing flap 52 moves freely into the joint space 36. A portion of the sealing flap 52 contacts the lower edge 50 of the inner skin 14 of the upper roller slat 10. Additionally, the free edge 54 of the sealing flap 52 rests against the upper edge 42 of the inner skin 14 of the lower roller slat 10A. In this manner, the sealing flap 52 creates air pockets 56 and 58 to aid in minimizing the heat transfer between the outside and the inside of the roller curtain.

Figure 4:
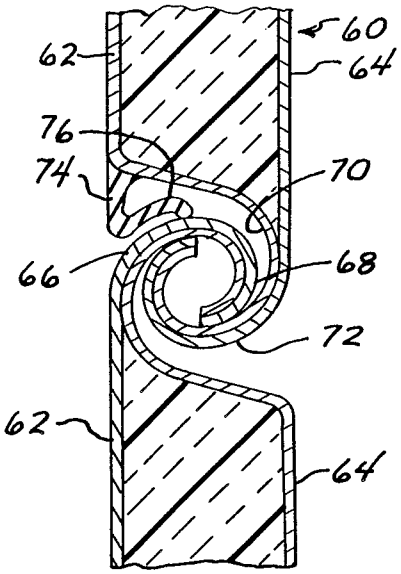
FIG. 4 is a view in vertical section of another embodiment of the invention for use with a roller curtain that employs a different type of joint.

Another embodiment of the invention is shown in FIG. 4. While this embodiment incorporates basically the same principle as the sealing edge 38 in FIGS. 1 and 2, a different joint means is utilized in FIG. 4. A slat 60 according to the embodiment of FIG. 4 has an inner skin 62 engaged with an outer skin 64. The upper portion of the inner skin 62 has a hook 66 which is flexibly secured against a hook 68 of the upper portion of the outer skin 64. Likewise, the lower portion of the inner skin 62 has a hook 70 which is flexibly secured against a hook 72 of the lower portion of the outer skin 64. Both of the lower hooks 70 and 72 of the upper slat 60 are inter-connected with the upper hooks 66 and 68 of the neighboring slat 60. Whereas the hook-like ridges 26 and 30 in FIG. 1 engage one another in the fashion of an edge bearing, the circular design of the hooks 66, 68, 70, and 72 of FIG. 4, work off the principle of a slide bearing.

The embodiment of the invention in FIG. 4 employs a sealing edge 74 which is attached to the inner skin 62 of the slats 60. A free edge 76 of the sealing edge 74 points toward the outer skin 64 of the upper slat 60 and rests under slight pressure against the outer surface of the hook 66 of the inner skin 62 of the lower slat 60, which causes a slight deformation of the sealing edge 74. The circular design of the joint between the slats 60 causes no further deformation of the sealing edge 74 when the roller curtain is raised, than when the roller curtain is lowered.

Figure 5:
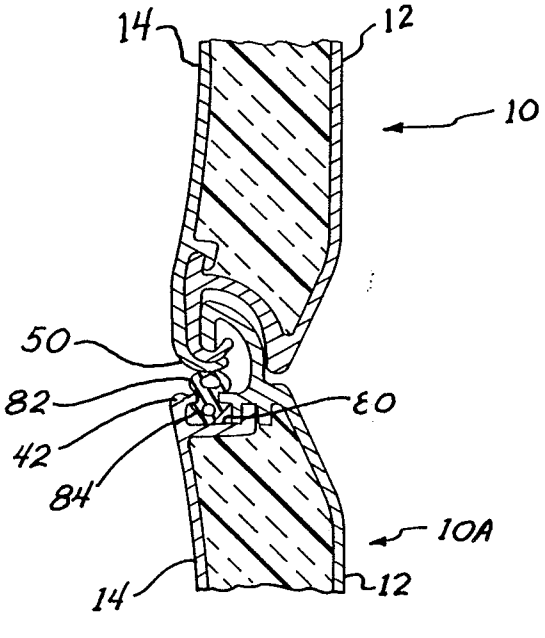
FIG. 5 is a view in vertical section showing another embodiment of the invention.

The design of FIG. 5 represents another embodiment of the invention. The shape of the outer skin 12 and the inner skin 14 are similar to those of FIG. 3, however, in FIG. 5 the outer skin 12 and the inner skin 14 are shaped to form a retaining channel 80. A bulb sealing edge 82 has a flared out retaining section 84 which is inserted into the retaining channel 80 at the upper edge 42 of the lower roller slat 10A. The bulb sealing edge 82 forms a seal by contacting the lower edge 50 of the inner skin 14 of the upper roller slat 10.

Figure 7:
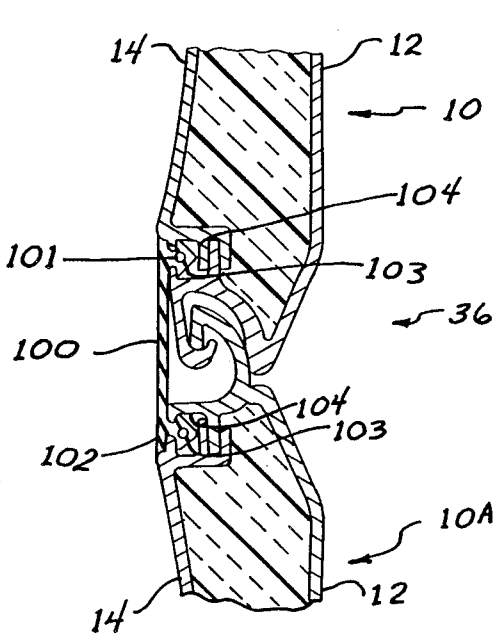
FIG. 7 is a view in vertical section similar to FIG. 6 but showing another embodiment of the invention.
Figure 6:
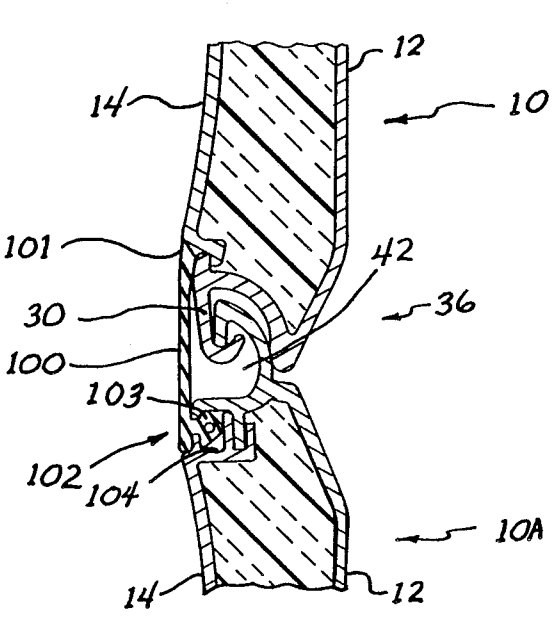
FIG. 6 is a view in vertical section showing another embodiment of the invention.

FIGS. 6 and 7 show different embodiments of the invention where the design of the sealing strip 100 hermetically seals off the inside of the joint space 36. In the design of FIG. 6, the upper edge 101 of the sealing strip 100 is fastened to the inner skin 14 of the upper roller slat 10 either through an adhesive process like glueing or through co-extrusion. The other end 102 of the sealing strip 100 has a flared out retaining section 103. The retaining section 103 is inserted into a retaining channel 104 which is formed between the inner skin 14 and the outer skin 12 of the lower slat 10A, when fully assembled. An air pocket 42 is formed by use of the sealing strip 100.

The sealing strip 100 contracts slightly when the roller curtain according to FIGS. 6 and 7 is in a rolled up position because the distance between the slats 10 and 10A becomes slightly shorter. Also, because the sealing strip 100 is located on the inside of the roller curtain, the sealing strip 100 is slightly depressed into the open joint space 36 without any harmful effect. For this reason, it is important that an area of free space is created between the hook-like ridge 30 of the upper roller slat 10 and its counterpart in the lower roller slat 10A into which the sealing strip 100 can fold without experiencing the stress of the curtain weight.

The design of FIG. 7 has basically the same functional features as shown in FIG. 6 with the exception that the sealing strip 100 has flared out retaining sections 103 on both ends. Each of the retaining sections 103 are secured within retaining channels 104 located on both the upper and lower rolling slats 10 and 10A. Thus, in the embodiment shown in FIG. 7, each slat 10 and 10A has two retaining channels 104. This allows the seal as described in this invention to be used even in instances where the sealing strip 100 cannot be attached to the inner skin 14 through coextrusion or adhesion.

Figure 8:
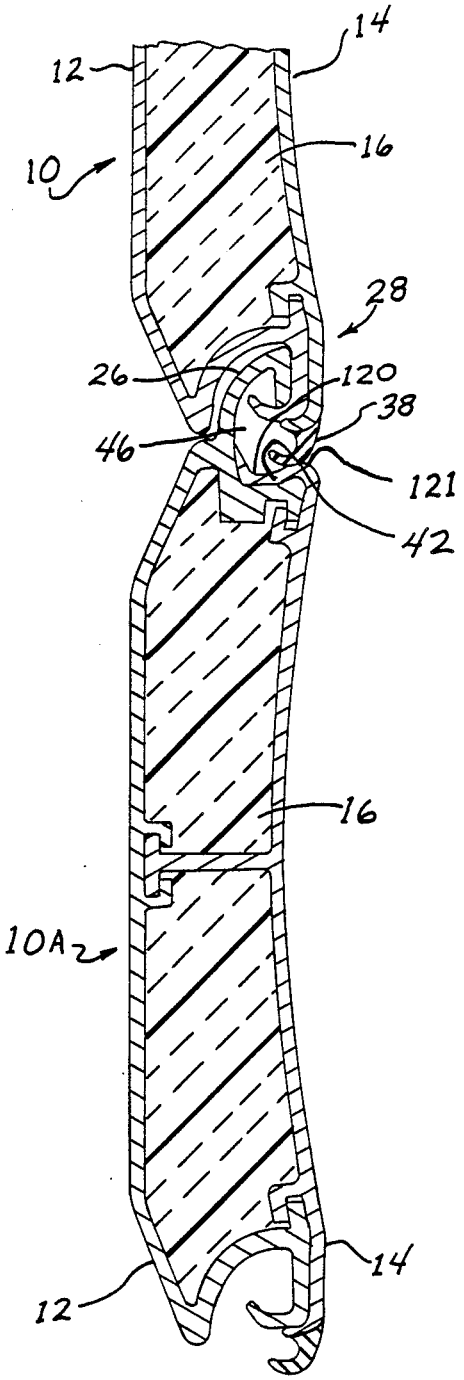
FIG. 8 is a view in vertical section similar to FIG. 1 but showing another embodiment of the invention.
Figure 9:
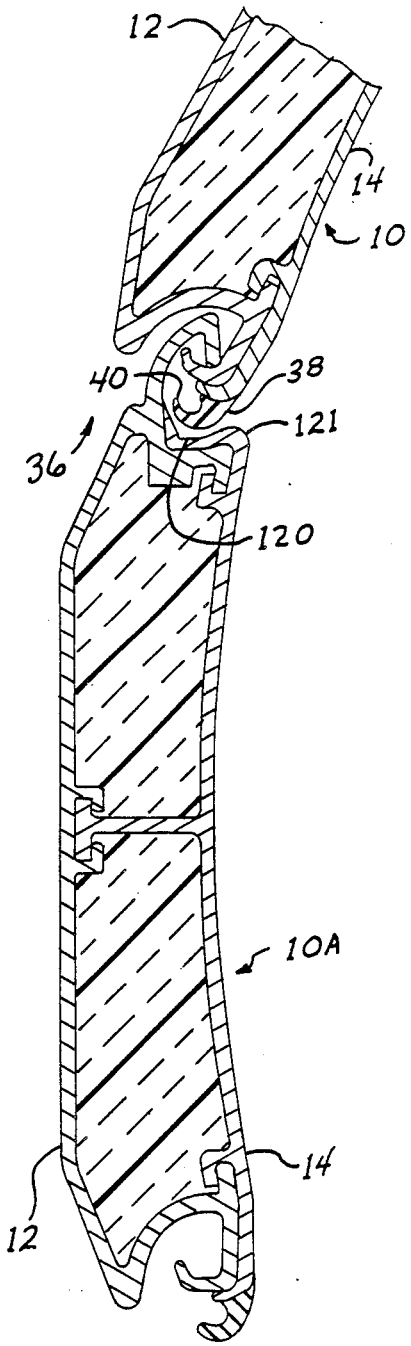
FIG. 9 is a view in vertical section similar to FIG. 8 but showing roller curtain according to FIG. 8 in the rolled up position.

The design in FIGS. 8 and 9 show another embodiment of the invention which is a modification of the design shown in FIG. 1 (Note that in the view of FIGS. 8 and 9, the inner skin 14 and the outer skin 12 are in opposite positions than in FIG. 1.) The inner skin 14 and the outer skin 12 in this embodiment are formed so as to create a depression 120. The depression 120 exists due to the form of the curvature of the upper edge 42 of the inner skin 14. The upper edge 42 is not curved in a circle about the pivot axis of the joint. Instead, an edge 121 is formed on the inner skin 14 that is closer to the pivot axis than are other portions of the edge 42. The sealing edge 38, as in the embodiment shown in FIG. 1, is attached to the lower edge 28 of the inner skin 14 of each roller slat 10. The sealing edge 38, preferably made of rubber or plastic, is connected to the inner skin 14 by either adhesion or co-extrusion. When the roller curtain is in the down position (FIG. 8), the slats 10 and 10A are in a common plane and the sealing edge 38 contacts the edge 121 of the inner skin 14 and creates an air pocket 46. Note that the sealing edge 38 is positioned between the edge 121 and the pivot axis of the joint. As in the embodiment shown in FIG. 1, the air pocket 46 advantageously insulates the inner skin 14 and the outer skin 12 from heat transfer.

The position of the roller slats 10 and 10A in FIG. 9 depicts their location when the roller curtain is in the rolled up position. The sealing edge 38 disengages from contact with the edge 121. In fact, as distinguished from the embodiment of the invention shown in FIG. 1, the free edge 40 of the sealing edge 38 in FIG. 9 does not contact any surface. Rather, when the curtain is rolled up, the free edge 40 houses next to the depressed area 120 formed by the inner skin 14 and the outer skin 12 without contacting any surface. This design significantly reduces the friction between the sealing edge 38 and the neighboring roller slat 10A because there is contact only when the curtain is closed. Thus, even in a dust-burdened atmosphere, practically all wear of the sealing edge 38 will be avoided. As in the embodiment of the invention shown in FIG. 1, however, the free edge 40 of the sealing strip 38 remains positioned between the upper edge 42 and the pivot axis of the joint. Also, as shown in FIGS. 8 and 9, the free edge 40 points toward the outer skin 12 regardless of whether the neighboring slats are in a common plane or not.

The foregoing detailed description has been for the purpose of illustration. Thus, a number of modifications and changes may be made without departing from the spirit and scope of the present invention. For example, the general shape of the roller slats 10 and 10A, and in particular the shape of the inner skin 14 and the outer skin 12, can be made without affecting the validity of the invention. Likewise, the means of attaching the sealing edges, flaps, or strips can be modified without detracting from the spirit of the invention. Therefore, the invention should not be limited by any of the specific embodiments described, but only by the claims.

I claim:

1. A roller curtain, comprising:

a plurality of interlocking curtain slats, each slat having an inner skin, an outer skin, and insulation between said inner and outer skins, each slat having hook-like elements which engage hook-like elements of a neighboring slat to form a joint connecting neighboring slats, said hook-like elements forming a joint space between the neighboring slats, and said inner skin having a curved, circular sealing surface whose center lies approximately at the pivot axis of said joint;

an elongated sealing strip formed of an elastic material, said sealing strip connected to an edge of said inner skin of at least one neighboring slat, said sealing strip connected opposite said sealing surface of the neighboring slat, and said sealing strip having a curved portion terminating in a free edge; and wherein:

said sealing strip extends into said joint space;

said free edge of said sealing strip points toward said outer skin and is positioned inside said joint space when the neighboring slats are in a common plane;

said sealing strip rests and seals against said sealing surface of said inner skin of the neighboring slat when the neighboring slats are in a common plane;

said free edge of said sealing strip points toward said outer skin and is positioned inside said joint space when the neighboring slats are not in a common plane; and said sealing strip rests and seals against said sealing surface of said inner skin of the neighboring slat when the neighboring slats are not in a common plane.

2. A roller curtain as in claim 1, wherein said free edge of said sealing strip is positioned between said sealing surface and the pivot axis of said joint.

3. A roller curtain as in claim 2, wherein said inner skin is formed of a relatively rigid plastic material and said sealing strip is formed of an elastic plastic material that is attached to said inner skin through co-extrusion.

4. A roller curtain as in claim 2, wherein said sealing surface is formed by an inwardly extending edge of said inner skin that extends into said joint space and over a hook-like element of said outer skin.

* * * * *